United States Patent [19]

Ogata et al.

[11] 3,952,128

[45] Apr. 20, 1976

[54] DURABLE ANTISTATIC AGENT, HYDROPHOBIC FIBERS AND FIBROUS STRUCTURES HAVING DURABLE ANTISTATIC PROPERTY AND METHOD OF MAKING SAME

[75] Inventors: Yuzuru Ogata, Wakayama; Yukihisa Niimi, Osaka, both of Japan

[73] Assignees: Kao Soap Co., Ltd.; Kanebo, Ltd., both of Tokyo, Japan

[22] Filed: Nov. 4, 1974

[21] Appl. No.: 520,379

Related U.S. Application Data

[62] Division of Ser. No. 284,863, Aug. 30, 1972, Pat. No. 3,864,317.

[30] Foreign Application Priority Data

Sept. 1, 1971 Japan ..... 46-67297

[52] U.S. Cl. ..... 428/265; 428/266; 428/267; 428/279; 428/288; 428/290; 428/394

[51] Int. Cl.[2] ..... B32B 27/00; D02G 3/00

[58] Field of Search ..... 428/262, 265, 266, 267, 428/272, 279, 288, 290, 296, 394; 427/421, 424, 428, 429, 430

[56] References Cited

UNITED STATES PATENTS 3,206,328 9/1965 Shaw ..... 428/394

*Primary Examiner*—Marion E. McCamish

*Attorney, Agent, or Firm*—Woodhams, Blanchard and Flynn

[57] ABSTRACT

A novel antistatic agent soluble in organic solvent which can afford durable antistatic property to hydrophobic fibers and fibrous structures is provided. Such antistatic agent consists substantially of a complex compound of a polyvinyl derivative having quaternary ammonium groups in its side chains, its counter anion being substituted with an anionic surfactant containing 2 to 8 ethylene oxide units, an ester-bonded sulfonate, an alkylamidocarboxylic acid salt or an amphoteric surfactant of carboxylic acid type.

Hydrophobic fibers and fibrous structures having durable antistatic property, and a process for producing such hydrophobic fibers and fibrous structures also are provided, by utilizing the above antistatic agent.

19 Claims, No Drawings

DURABLE ANTISTATIC AGENT, HYDROPHOBIC FIBERS AND FIBROUS STRUCTURES HAVING DURABLE ANTISTATIC PROPERTY AND METHOD OF MAKING SAME

This is a division, of application Ser. No. 284,863, filed Aug. 30, 1972, now U.S. Pat. No. 3,864,317.

BACKGROUND OF THE INVENTION

1. Field of the Invention

The present invention relates to a novel antistatic agent soluble in organic solvent which can afford durable antistatic property, highly resistant to washing and dry cleaning, to hydrophobic fibers made of such polymers as polyester, polyacrylic, polyamide, polyvinylchloride, polyethylene and polypropylene polymers as well as fibrous structures such as cloth and knit fabrics made of such fibers, if applied to those fibers or fibrous structures in an organic solvent system.

Further, the present invention relates to hydrophobic fibers and fibrous structures having durable antistatic property and a method for producing such fibers and fibrous structures.

2. Description of the Prior Art

Hydrophobic fibers and fibrous structures made of such fibers as mentioned above have excellent properties such as toughness and chemical resistance, but, as they are hydrophobic, they have great volume specific resistance and, therefore, they tend to produce a remarkable static electrification phenomenon even by a slight friction, thus causing various electrostatic faults.

Such faults will not only hinder a normal operation of the process steps for producing textile goods from textile fibers, for example, drawing and twisting, winding, warping, knitting and weaving, sewing, etc., but also cause lowering of product qualities or various troubles such as stains on products due to dust absorption and unpleasant feelings to human bodies.

There have been proposed various methods for preventing electrostatic faults of hydrophobic fibers and fibrous structures made of such fibers. There are known methods of adding a material having antistatic property to a fiber-forming polymer substance so as to make it copolymerize or blend with the polymer substance (for example, refer to Japanese Patent Publication No. 24143/1971) and methods of attaching a material having antistatic property on fibers or fibrous structures (for example, refer to Japanese Patent Publication No. 9849/1964, Japanese Patent Publication No. 22920/1971 and U.S. Pat. No. 2,729,577).

However, the former method has disadvantages such as the low dispersibility of the antistatic agent is liable to cause breaking of yarns and occurence of knotted yarns during melt spinning or lowering of qualities such as reduction of strength and elasticity. Further, due to thermal deterioration caused in melt spinning, dispersion into the coagulating bath in wet spinning, etc., only special kinds of antistatic agents can be used.

On the other hand, the latter method is a temporary antistatic treatment method, in which, since the antistatic agent is stripped off by washing, the antistatic effect is gradually lowered or completely lost, which has not only the disadvantages of hurting the feeling of fibrous structures, but also has a greater disadvantage of not having a durable antistatic effect.

Further, in conventional methods for antistatic treatment of fibrous structures, many of them use emulsions of antistatic agents added with emulsifiers, which lack in durability such as mentioned above. Therefore, they do not provide a durable antistatic effect. Further, among those conventional antistatic agents which have been utilized in an aqueous medium or system, those having relatively low HLB values could be utilized in a solvent system, because they are solvent soluble, but they have been insufficient with respect to their durabilities.

Recently, methods for treating hydrophobic fibrous structures by using an organic solvent as medium which is superior to a conventional method of treatment wherein water is used as medium have attracted attention because of their efficiency and economical advantage and also because of the fact that enviornmental pollution by waste water has posed a social problem. However, effective and durable antistatic agents which can be used in an organic solvent system cannot be found among conventional antistatic agents.

SUMMARY OF THE INVENTION

We have made extensive researches for obtaining hydrophobic fibers and fibrous structures which show excellent durable antistatic property and have excellent hand, and accomplished the present invention.

In the specification and claims, the words "fibrous structure" means staple fibers, continuous filaments, woven fabrics, knitted fabrics, non-woven fabrics, battings and the like.

The primary object of the present invention is to provide an antistatic agent which is soluble in an organic solvent to form a stable solution and which has a high resistance against washing and dry cleaning when applied to hydrophobic fibers or fibrous structures.

Another object of the present invention is to provide fibers and fibrous structures having durable antistatic property and also having excellent hand.

Another object of the present invention is to provide a process for producing fibers and fibrous structures having durable antistatic property and also having excellent hand easily on an industrial scale and economically.

The above objects of the invention can be attained by using, as the durable antistatic agent to be used in an organic solvent medium or system, a complex compound consisting of a polyvinyl derivative having a quaternary ammonium group in its side chain and having a counter anion derived from a particular anionic surfactant or an amphoteric surfactant as defined below.

In case a fibrous structure is treated with a cationic polymer as an antistatic agent, it is generally apt to be given a hard hand feeling. However, when the antistatic agents according to the present invention are used, a desirable soft hand can be imparted to the textile material. This is one of characteristic features of the invention.

The durable antistatic agent for solvent system of the present invention comprises a complex compound consisting of a polyvinyl derivative having a quaternary ammonium group in its side chain, the counter anion thereof being substituted with at least one surface active compound selected from the group consisting of anionic surfactants containing 2 – 8 ethylene oxide units, ester-bonded sulfonates, alkylamidocarboxylic acid salts and amphoteric surfactants of the carboxylic acid type.

Further, the present invention provides hydrophobic fibers and fibrous structures having durable antistatic property which contain 0.1 to 10% by weight of a complex compound consisting of a polyvinyl derivative having a quaternary ammonium group in its side chain, the counter anion thereof being substituted with at least one surface active compound selected from the group consisting of anionic surfactants containing 2 – 8 ethylene oxide units, ester-bonded sulfonates, alkylamidocarboxylic acid salts and amphoteric surfactants of the carboxylic acid type.

Also, the process of the present invention comprises treating a hydrophobic fibrous structure with an organic solvent solution consisting of 0.05 to 10% by weight of a complex compound consisting of a polyvinyl derivative having a quaternary ammonium group in its side chain, the counter anion thereof being substituted with at least one surface active compound selected from the group consisting of anionic surfactants containing 2 – 8 ethylene oxide units, ester-bonded sulfonates, alkylamidocarboxylic acid salts and amphoteric surfactants of the carboxylic acid type, 0.05 to 20% by weight of alcohols and more than 70% by weight of at least one organic solvent selected from the group consisting of hydrocarbons, halogenated hydrocarbons, ethers, ketones and esters, the weight ratio of said alcohols to said complex compound being more than 0.2/1.

The polyvinyl derivatives having quaternary ammonium groups in their side chains to be used in the present invention are those obtained by, for example, the following processes:

(1) A process which comprises homopolymerizing a vinyl monomer having at least one tertiary amine residue in the molecule or copolymerizing the same with another copolymerizable vinyl monomer and then quaternizing the resulting polymer by a suitable quaternizing agent, or (2) A process which comprises homopolymerizing a vinyl monomer having at least one quaternary ammonium group in the molecule or copolymerizing the same with another copolymerizable vinyl monomer.

The vinyl monomers having at least one tertiary amine residue in the molecule are those represented by the general formula:

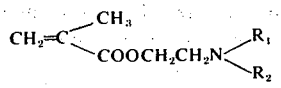

The vinyl monomers having at least one quaternary ammonium group in the molecule are those represented by the general formula:

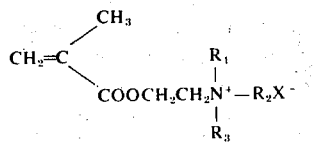

wherein $R_1$, $R_2$ and $R_3$ represent methyl or ethyl group, X represents a halogen, methosulfate or ethosulfate.

The "other copolymerizable vinyl monomers" mentioned above are compounds of the general formula:

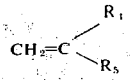

wherein $R_4$ and $R_5$ are vinyl residues, and preferably $R_4$ represents hydrogen or methyl and $R_5$ represents an alkoxycarbonyl group, alkoxy group, $—CONH_2$, —COOH, —CN or $—C_6H_5$.

Particularly preferred copolymerizable vinyl monomers are acrylic acid, acrylic esters, acrylonitrile, styrene and acrylamides.

In the above process (1), conventional quaternizing agents such as dimethylsulfate, diethylsulfate, methyl halides and ethyl halides may be used for the quaternization of the tertiary amines.

The molar ratio of the vinyl monomer having a tertiary amine residue or vinyl monomer containing quaternary ammonium group to the other copolymerizable vinyl monomer is properly 1:0–1.

The complex compound of the present invention comprises the above polyvinyl derivative containing quaternary ammonium groups in its side chains, but the counter anion thereof being substituted with a particular anionic surfactant or amphoteric surfactant.

As such particular anionic surfactants, there may be used at least one anionic surfactant selected from the group consisting of anionic surfactants containing 2 – 8 ethylene oxide units (preferably 3 – 5 ethylene oxide units), ester-bonded sulfonates and alkylamidocarboxylic acid salts.

Further, such particular amphoteric surfactants are those of carboxylic acid type.

As examples of those surfactants, there may be mentioned the following compounds: Sodium dioxyethylene dodecyl ether sulfate, sodium trioxyethylene dodecyl ether sulfate, sodium trioxyethylene-n-nonylphenyl ether sulfate, sodium pentaoxyethylene dodecyl ether sulfate, sodium octaoxyethylene-n-nonylphenyl ether sulfate, sodium trioxyethylenedodecyl ether monophosphate, sodium trioxyethylene-n-nonylphenyl ether monophosphate, sodium trioxyethylenedodecyl ether carboxymethylate, sodium trioxyethylene-n-nonylphenyl ether carboxymethylate, sodium trioxyethylene-n-nonylphenyl ether β-carboxy ethylate, sodium dioctylsuccinate monosulfonate, N-methyl-N-(sodium carboxymethyl)lauroamide, sodium N-lauroylglutamate, sodium 2-carboxyethyldodecylamine, sodium carboxymethyldodecylamine, di(sodium carboxymethyl)-dodecylamine and di(sodium 2-carboxymethoxyethyl)-dodecylamine.

The antistatic agent of the present invention, that is to say, the complex compound as mentioned above, is applied to the textile material (textiles or fabrics) in an amount of 0.1 to 10% by weight, preferably 0.2 to 3% by weight, most preferably 0.3 to 1.0% by weight. When the attached amount is less than 0.1% by weight, the antistatic effect is still insufficient, while, when it exceeds 10% by weight, the hand or feeling of the finished textile material is remarkably lowered, though the antistatic effect is improved.

The hydrophobic fibers to be treated in the present invention include polyesters, polyacrylonitrile, polyamides, polyvinyl chloride, polyethylene and polypropyrene, but polyesters and polyacrylonitrile are preferable. Further, the fibrous structures (woven, knitted, etc.) to be treated in the present invention mean staple fibers, continuous filaments, clothes, woven goods, knitted goods, non-woven clothes, battings, etc. which should contain more than 50% by weight of said hydrophobic textiles.

The application of the antistatic agent (complex compound) to the fibers or fibrous structures to be treated should be carried out by utilizing an organic solvent as the medium.

The concentration of the complex compound in the organic solvent solution should be in the range of 0.05 to 10% by weight, preferably 0.2 to 3.0% by weight. Particularly, 0.3 to 1.0% by weight is most preferable. In case the antistatic agent concentration is less than 0.05% by weight, it is impossible to put a required amount of the complex compound on the textile material uniformly and, further, the production efficiency is lowered. On the other hand, when it exceeds 10% by weight, the uniform application of the antistatic agent becomes impossible owing to the increase of the solution viscosity and adhesive substances (socalled gum) will be adhered to the machinery and the textile fabrics, and product qualities and workability will be remarkably lowered.

As the alcohols to be used in the present invention, methyl alcohol, ethyl alcohol, isopropyl alcohol, n-butyl alcohol, isoamyl alcohol, n-octyl alcohol, benzyl alcohol, o-chlorophenyl, m-cresol, n-hexyl alcohol are exemplified. Ethyl alcohol and isopropyl alcohol are particularly suitable. The amount of alcohols in the organic solvent solution should be in the range of 0.05 to 20% by weight, preferably 0.2 to 6% by weight, most preferably 0.3 to 2% by weight. Further, the amount of alcohols should be at least 0.2 part by weight based on 1 part by weight of the antistatic agent (complex compound), but alcohols should be preferably used in the amount of 0.5 to 30 parts by weight, particularly 1 to 20 parts by weight to 1 part by weight of the complex compound. In case the alcohol concentration is less than 0.05% by weight, the preparation of the antistatic agent solution will be difficult, while, in case it exceeds 20% by weight, deterioration of the product qualities, particularly discoloring of the product, will be caused. Further, if the ratio of the amount of alcohols to the amount of the complex compound is less than 0.2/1, it will be difficult to dissolve the antistatic agent into the solvent solution.

As organic solvents, there can be used hydrocarbons such as n-hexane, cyclohexane, benzene, and toluene; halogenated hydrocarbons such as methyl chloride, methylenechloride, chloroform, carbontetrachloride, methylchloroform, dichloroethane, trichloroethylene, tetrachloroethane, perchloroethylene, dichlorobenzene and trichlorobenzene; ethers such as diethyl ether, methylethylether and ethylpropylether; ketones such as acetone and methylethylketone; esters such as ethyl acetate, methyl acetate and butyl acetate. Halogenated hydrocarbons, particularly methylchloroform, trichloroethylene and perchloroethylene are preferable. The organic solvent should be used in a concentration of at least 70% by weight, but the concentration is preferably in the range of 92 to 99.6% by weight and more preferably in the range of 97 to 99.4% by weight. In case, the concentration of the organic solvent is less than 70% by weight, the alcohol concentration is so much increased that deterioration of product qualities, particularly discoloration of the product might be caused.

The organic solvent solution of the antistatic agent (i.e., complex compound) can be usually prepared by swelling and dissolving the complex compound in a predetermined weight ratio of alcohols and then dissolving the obtained solution in the organic solvent.

The organic solvent solution of the complex compound thus obtained can be applied to a fibrous structure by any conventional method such as dipping, padding, coating and spraying. Generally, padding and coating are suitable to woven fabrics, and dipping, spraying and padding are suitable to knitted fabrics. Further, in case of filament and tow, dipping and spraying are suitable.

The amount of said organic solvent solution to be applied to a fibrous structure depends on the concentration of said solution, the kinds of the material to be treated and the amount of the complex compound to be attached, but, for example, in the case of treating a woven fabric by a dipping method, the liquid is squeezed so as to make the solution to be 30 to 150% by weight based on the fabric prior to the treatment by said organic solvent solution, the material to be treated should be preferably washed by said organic solvent, because such pretreatment will assist a uniform adhesion of the antistatic agent and increase the durability of the antistatic property.

The fibrous structure treated by the antistatic agent of the present invention can be used as a final product as it is, but also it can be further subjected to a resin finishing. Further, if the fibrous structure should be treated by a melamine resin, the melamine resin can be simultaneously used with the organic solvent solution of the present invention and, therefore, the omission of a particular resin finishing step is possible. In the case of the simultaneous use of a melamine resin, the durability of the antistatic effect can be increased without lowering the antistatic property.

The process of the present invention can be carried out at room temperature to obtain excellent effects, but, generally, the durability can be further increased by treating a fibrous structure under heat, after the organic solvent solution is applied to the fibrous structure and the solvent is removed therefrom. The temperature of such heat treatment depends on the kinds of the fibrous strusture, but it is generally in the range of 60° to 210°C and the treatment is carried out for 10 seconds to 20 minutes. Particularly, the range of 110° to 190°C is preferable. The heat treatment is carried out, for example, in a temperature of 150° to 200°C for polyesters and in a temperature of 110° to 160°C for polyacrylonitriles.

The fibrous structures to be treated according to the process of the present invention include yarn dyed goods, piece dyed goods and scoured and bleached goods. Further, the process can be applied to such secondary goods such as sweaters and jumpers.

In the process of the present invention, wetting or penetrating agents, stabilizing agent, etc. such as dialkylsulfosuccinates and alkyl phosphates can be preferably used to increase the solution stability of the organic solvent solution. Further, softening agents and other kinds of antistatic agents can be used together, if necessary.

The fibers or fibrous structures thus obtained have an excellent antistatic effect, particularly a remarkably improved durability compared to conventionally available products and, therefore, the antistatic effect of the obtained fibers or fibrous structure is not lowered by washing. Further, in case a melamine resin is used together, the durability of the antistatic effect is further increased, in addition to the resin finishing effect. Also, the color fastness to rubbing is not lowered and the occurence of water spots can be prevented.

The present invention will now be illustrated in more detail by way of Examples.

EXAMPLE 1

Preparation of poly(2-methacryloyloxyethyldimethylethylammonium ethosulfate) (hereinafter will be referred to as "homopolymer A")

In a 15 liter four-neck flask provided with a Dimroth condenser, a thermometer, a dropping funnel and a blowing pipe, 1088 g (7 moles) of 2-dimethylaminoethylmethacrylate are charged. Then, 1078 g (7 moles) of diethyl sulfate are added thereto dropwise over about 1.5 hours under countrol of generation of heat while temperature should be kept at below 50°C. After the exothermic reaction has ceased, the mixture is stirred at 50°C for 30 minutes in air to complete the quaternization reaction. Thereafter, 8191 g of water were added thereto to obtain the aqueous solution. After thorough replacement of air in the system with nitrogen gas, a solution of 17.4 g of potassium persulfate in 500 g of water is added to the mixture and the whole is allowed to react at 50°C for 7 hours under stirring. The conversion was 96.3% and the viscosity of the obtained solution was 368 cp. (20% aqueous solution at 30°C).

EXAMPLE 2

Preparation of a complex compound from the homopolymer A obtained in Example 1 and sodium trioxyethylene-n-nonylphenyl ether sulfate 117 grams of sodium trioxyethylene-n-nonylphenyl ether sulfate (25% aqueous solution) are added dropwise to 100 g of an aqueous solution of homopolymer A (20% solution) with vigorous stirring. A precipitate is formed as soon as the addition starts but the addition with stirring is continued regardless of the precipitation. After completion of the addition, the reaction is continued further at a room temperature for additional 30–60 minutes to complete the reaction. The precipitate is collected by filtration under reduced pressure, washed thoroughly with water of 2 to 3 times as much as the precipitate several times and dried at 60°C under reduced pressure overnight to obtain 39 g of a white solid product (yield 98.3%).

EXAMPLE 3

Preparation of a complex compound from homopolymer A and sodium trioxyethylene-dodecyl ether sulfate To 100 g of 20% aqueous homopolymer A solution, 100 g of sodium trioxyethylene dodecyl ether sulfate (25% aqueous solution) are added dropwise with vigorous stirring. A precipitate is formed as soon as the addition starts. By the same procedures as in Example 2, 36 g of a pale yellowish brown solid product are obtained (yield 96%).

EXAMPLE 4

Preparation of a complex compound from homopolymer A and sodium pentaoxyethylene-n-nonylphenyl ether monophosphonate To 100 g of 20% aqueous homopolymer A solution, 137 g of sodium pentaoxyethylene-n-nonylphenyl ether monophosphonate (25% aqueous solution) are added dropwise with vigorous stirring. By the same procedures as in Example 2, 40 g of a white solid product are obtained (yield 89.5%).

EXAMPLE 5

Preparation of a complex compound from homopolymer A and sodium dioctylsuccinate sulfonate To 100 g of 20% aqueous homopolymer A solution, 115 g of sodium dioctylsuccinate sulfonate (25% aqueous solution) are added dropwise with vigorous stirring. By the same procedures as in Example 2, 37 g of a light brown resinous solid product are obtained (yield 96.7%).

EXAMPLE 6

Preparation of copolymer of styrene and 2-methacryloyloxyethyldimethylethylammonium ethosulfate (which will be refer to as "copolymer B" hereinbelow)

In a 2 liter four-neck flask provided with a Dimroth condenser, a thermometer, a dropping funnel and a blowing pipe, 104 g (1 mole) of styrene and 157 g (1 mole) of 2-dimethylaminoethyl methacrylate are dissolved in 559 g of dioxane. After thorough replacement of air in the system with nitrogen gas, a solution of 1.3 g of azobisisobutylonitrile in 50 g of dioxane is added thereto. After the polymerization reaction at 50°C for 10 hours, a solution of 3 g of azobisisobutylonitrile in 50 g of dioxane is further added to the mixture and the polymerization is continued at 50°C for further 15 hours. After completion of the polymerization, 154 g (1 mole) of diethylsulfate are added to the mixture and the temperature is elevated to 80°C to effect the quaternization reaction. A precipitate occurs immediately and the reaction is continued for further one hour.

After completion of the quaternization reaction, dioxane is distilled off under reduced pressure and the residue is dissolved in water to obtain 2340 g of 17.7% viscous, milky aqueous solution.

EXAMPLE 7

Preparation of a complex compound from the copolymer B obtained in Example 6 and sodium dioctylsuccinate sulfonate To 100 g of 17.7% aqueous copolymer B solution, 76 g of 25% aqueous sodium dioctylsuccinate sulfonate solution are added dropwise with vigorous stirring at a room temperature. After completion of the addition, stirring is continued at a room temperature for further one hour to complete the precipitation and the resulting precipitate is gathered by filtration. The filtered precipitate is washed thoroughly with water and dried at 60°C under reduced pressure overnight to obtain 27 g of white solid (yield 89.0%).

EXAMPLE 8

Preparation of a complex compound from copolymer B and sodium pentaoxyethylene-n-nonylphenyl ether phosphate To 100 g of 17.7% aqueous copolymer B solution, 91.5 g of 25% aqueous sodium pentaoxyethylene-n-nonylphenyl ether phosphate solution are added dropwise with vigorous stirring at room temperature. By the same procedures as in Example 7, 33 g of a light yellow solid product are obtained (yield 96.5%).

EXAMPLE 9

Preparation of a complex compound from copolymer B and sodium trioxyethylene-n-nonylphenyl ether sulfate By adding sodium trioxyethylene-n-nonylphenyl ether sulfate to the aqueous copolymer B solution in the same manner as in Example 7, a light yellow solid product is obtained (yield 98%).

EXAMPLE 10

Preparation of copolymer of acrylonitrile and 2-methacryloyloxyethyldimethylethylammonium ethosulfate (which will be referred to as "copolymer C" hereinafter)

In a 5 liter flask similar to that used in Example 6, 159 g (3 moles) of acrylonitrile and 311 g (1 mole) of 2-methacryloyloxyethyldimethylethyl ammonium ethosulfate are dissolved in 4073 g of water and air in the reaction system is replaced thoroughly with nitrogen gas. Thereafter, a solution of 4.7 g of potassium persulfate in 100 g of water and successively a solution of 1.8 g of sodium bisulfite in 50 g of water are added to the mixture at 25°C and stirring is effected at 25°C for 13 hours to complete the polymerization. A part of the thus resulting polymer [degree of polymerization = 95%, viscosity of the solution = 7.4 cp. (10% aqueous solution at 30°C)] is taken, from which water is then removed thoroughly and the nitrogen content in the residue is measured according to the Kjeldahl method. The nitrogen content is 5.69%. From the result, it is supposed that the proportion of acrylonitrile monomer to the quaternary salt monomer in the copolymer is about 0.336 mole to 1 mole.

EXAMPLE 11

Preparation of copolymer of acrylonitrile and 2-methacryloyloxyethyldimethylethylammonium ethosulfate (which will be referred to as "copolymer D" hereinafter) and quaternization of the copolymer D 159 grams (3 moles) of acrylonitrile and 157 g (1 mole) of 2-dimethylaminoethyl methacrylate are dissolved in 2742.4 g of dioxane and air in the reaction system is replaced thoroughly with nitrogen gas. Thereafter, a solution of 0.316 g of azobisisobutylonitrile in dioxane is added to the mixture and the polymerization is carried out at 50°C. A solution of 0.316 g of azobisisobutylonitrile in 20 g of dioxane is added thereto after every 10, 20, 30 and 40 hours. The polymerization is completed after 50 hours. The conversion is 93.6% and $[\eta]^{30°C}_{dioxane} = 0.358$. A part of the thus resulting polymer is taken, from which water is then removed thoroughly and the nitrogen content in the residue is measured according to the Kjelkahl method. The nitrogen content is 10.77%. From the result, it is supposed that the proportion of acrylonitrile to 2-dimethylaminoethyl methacrylate in the copolymer is about 0.349 mole to 1 mole.

146 grams of diethylsulfate are added to 3 Kg of the above aqueous polymer solution and the temperature is elevated to 80°C to effect the quaternization. Immediately, precipitate is formed. The reaction is continued at 80°C for one hour. Thereafter, dioxane is distilled off under reduced pressure and the residue is dissolved in water to obtain an aqueous solution of the quaternized copolymer. The viscosity of the solution is 11.3 cp. (10% aqueous solution at 30°C).

EXAMPLE 12

Preparation of a complex compound from copolymer C obtained in Example 10 and sodium trioxyethylene dodecyl ether sulfate The quaternary ammonium group of the copolymer C is reacted with an equimolar amount of sodium trioxyethylene dodecyl ether sulfate in the same manner as in Example 3 to obtain a solid product (yield 95%).

EXAMPLE 13

Preparation of a complex compound from copolymer D prepared and quaternized in Example 11 and sodium trioxyethylene dodecyl ether sulfate The reaction is carried out in the same manner as in Example 12 and a solid product is obtained (yield 90%).

EXAMPLE 14

Preparation of a complex compound from homopolymer A, sodium dioctyl succinate sulfonate and sodium lauryl sulfate In the same manner as in Example 12, sodium dioctyl succinate sulfonate and sodium lauryl sulfate (molar ratio = 1:1) are reacted with homopolymer A to obtain a solid product (yield 100%).

EXAMPLE 15

Preparation of a complex compound of homopolymer A and sodium lauryloyl sarcosinate [$C_{11}H_{23}CON(CH_3)CH_2COONa$]

By reacting the starting materials in the same manner as in Example 12, a solid product is obtained (yield 95%).

EXAMPLE 16

Preparation of a complex compound from homopolymer A, dodecyldimethylaminocarboxymethylbetaine ($C_{12}H_{25}.N^+(CH_3)_2.CH_2COO^-$) and sodium lauryl sulfate Homopolymer A is reacted with dodecyldimethylaminocarboxymethylbetaine and sodium lauryl sulfate (molar ratio 1:1) in the same manner as in Example 12 to obtain a solid product (yield 90%).

EXAMPLE 17

Preparation of a complex compound from homopolymer A, sodium trioxyethylene dodecyl ether sulfate and potassium n-octylsesquiphosphate Homopolymer A is reacted with sodium trioxyethylene dodecyl ether sulfate and potassium n-octylsesquiphosphate (molar ratio 1:1) in the same manner as in Example 12 to obtain a solid product (yield 93%).

EXAMPLE 18

A complex compound is obtained from homopolymer A and $C_{11}H_{23}CON(CH_3)CH_2CH_2COONa$ in the same manner as in Example 12.

EXAMPLE 19

A complex compound is obtained from homopolymer A and a compound of the following formula in the same manner as in Example 12:

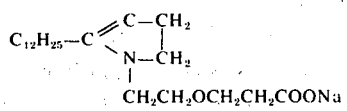

EXAMPLE 20

A complex compound is obtained in the same manner as in Example 3 except that sodium dioxyethylene dodecyl ether sulfate is used.

EXAMPLE 21

A complex compound is obtained in the same manner as in Example 3 except that sodium octaoxyethylene dodecyl ether sulfate is used.

Referential Example 1

A complex compound is obtained from homopolymer A and sodium laurate in the same manner as in Example 12.

Referential Example 2

A complex compound is obtained from homopolymer A and lauryl sulfate in the same manner as in Example 12.

Each of the compositions prepared in the above Examples was dissolved in perchloroethylene, trichloroethylene or methylchloroform to obtain a solution of 0.3% solid content. An aliquot of 100 ml from the solution was placed in a beaker as the treating solution. In the treating solution, sample cloth pieces (20 × 20 cm) of each of fabrics of polyester (tropical: dyed in a dark color), nylon (tricot: not dyed) and acrylic (knitted fabric: not dyed) were immersed at a room temperature for 10 seconds. They were squeezed with a mangle to 120 wt. % liquid, air-dried and subjected to heating at 160°C for 2 minutes. The following tests of properties were carried out:

1. Antistatic property:

Five test pieces in round shape (diameter 5 cm) were cut from the treated cloth and allowed to stand at 25°C under 40% RH for 24 hours. Insulating resistance (surface electrical resistivity) of the test pieces was measured with a resistance meter (manufactured by Horikawa Denki Co.). Average of the five values was taken as the antistatic property.

2. Resistance to washing (wet method):

Five test pieces same as in the above item 1 were placed in a container of a laundry tester, which were then added with 100 ml of 0.2% aqueous solution of a detergent ("New Wonderful" of Kao Soap Co., Ltd.). Washing was done at 40°C for 20 minutes. The same washing procedure was repeated ten times. Finally, the test pieces were washed twice each with 1 liter of warm water, dehydrated and dried and the antistatic property was measured in the same manner as in item 1.

3. Resistance to dry cleaning:

Five round test pieces (the same as in item 1) were placed in the laundry tester and washed with 100 ml of a perchloroethylene solution containing 1% of a blend of anionic and non-ionic surfactants (Charge Soap P of Kao Soap Co., Ltd.) and 0.1% of water at 30°C for 30 minutes. The test pieces were rinsed finally each eaach with 100 ml of perchloroethylene.

4. Color fastness to rubbing:

After 100 rubbings with a rubbing tester under a load of 200 g, the results were evaluated according to the specification of JIS-L-1048. As the number is larger, the color fastness is better.

5. Hygroscopicity:

A drop of water was applied on the test piece through a burette and the time (in second) required for penetration was measured.

6. Feeling (Hand):

Mainly softness was judged by handling.

When the untreated sample cloth (blank) is ○ ~Δ,

○ : Softer than blank

Δ : A little harder than blank

X : Harder than blank

The test results of the properties of the samples examined according to the above described methods of judgement or measurement were as shown in the following Tables 1 to 3.

T, P and M in the following tables indicate trichloroethylene, perchloroethylene and methylchloroform, respectively. Compounds of the referential examples did not dissolve in a solvent such as perchloroethylene or trichloroethylene to make a stable solution. Further, the compound of Referential Example 1 was far inferior in the color fastness to rubbing.

One of the ingredients of each of the surfactant mixtures used in Examples 14 and 16 is the complex compound of the present invention, but the other ingredient is not the one according to the present invention. However, by using such a combination, excellent results as shown in the following Tables 1 to 3 can be obtained.

Table 1

| Polyester cloth (made of textured yarn and dyed in a dark color) | | | | | | | | | | |
|---|---|---|---|---|---|---|---|---|---|---|
| Example No. | Solvent for treatment | Antistatic property (insulating resistance Ω) Before laundry | After laundry (5 times) Wet | After laundry (5 times) Dry | After laundry (10 times) Wet | After laundry (10 times) Dry | Color fastness to rubbing Wet | Color fastness to rubbing Dry | Hygroscopicity (second) | Feeling |
| 2 | T | $8.9\times10^{7}$ | $5.5\times10^{9}$ | $3.6\times10^{9}$ | $6.5\times10^{9}$ | $6.8\times10^{9}$ | 3 | 4–5 | 16 | Δ - ○ |
| 3 | P | $7.5\times10^{7}$ | $4.2\times10^{9}$ | $2.6\times10^{9}$ | $8.2\times10^{9}$ | $4.1\times10^{9}$ | 3–4 | 4–5 | 81 | Δ - ○ |
| 4 | P | $1.3\times10^{8}$ | $6.1\times10^{9}$ | $2.2\times10^{9}$ | $7.9\times10^{9}$ | $4.4\times10^{9}$ | 3 | 4 | 54 | Δ - ○ |
| 5 | P | $2.2\times10^{8}$ | $8.2\times10^{9}$ | $3.9\times10^{9}$ | $1.1\times10^{10}$ | $7.2\times10^{9}$ | 2–3 | 4–5 | 32 | Δ |
| 7 | P | $1.1\times10^{8}$ | $7.3\times10^{9}$ | $3.8\times10^{9}$ | $8.1\times10^{9}$ | $5.5\times10^{9}$ | 3–4 | 4–5 | 52 | Δ - X |
| 8 | T | $2.6\times10^{8}$ | $4.4\times10^{9}$ | $2.6\times10^{9}$ | $7.7\times10^{9}$ | $5.6\times10^{9}$ | 4 | 4 | 26 | Δ |
| 9 | T | $3.3\times10^{8}$ | $6.2\times10^{9}$ | $1.6\times10^{9}$ | — | — | 4 | 4 | Above 3 mins. | Δ |
| 12 | P | $1.0\times10^{8}$ | $9.5\times10^{9}$ | $2.1\times10^{9}$ | — | — | 3–4 | 4 | 150 | Δ - ○ |

Table 1-continued

| Example No. | Solvent for treatment | Antistatic property (insulating resistance Ω) Before laundry | After laundry (5 times) Wet | After laundry (5 times) Dry | After laundry (10 times) Wet | After laundry (10 times) Dry | Color fastness to rubbing Wet | Color fastness to rubbing Dry | Hygroscopicity (second) | Feeling |
|---|---|---|---|---|---|---|---|---|---|---|
| Polyester cloth (made of textured yarn and dyed in a dark color) | | | | | | | | | | |
| 13 | T | $1.5\times10^{8}$ | $1.1\times10^{10}$ | $3.3\times10^{9}$ | — | — | 4–5 | 5 | 5 | Δ - ○ |
| 14 | P | $2.5\times10^{8}$ | $8.1\times10^{9}$ | $1.6\times10^{9}$ | — | — | 4 | 4–5 | Above 3 mins. | ○ |
| 15 | P | $1.8\times10^{8}$ | $7.6\times10^{9}$ | $3.8\times10^{9}$ | — | — | 3 | 4 | 15 | ○ |
| 16 | T | $5.5\times10^{7}$ | $5.4\times10^{9}$ | $1.6\times10^{9}$ | — | — | 2–3 | 4 | Above 3 mins. | Δ |
| 17 | P | $8.5\times10^{7}$ | $3.1\times10^{9}$ | $1.9\times10^{9}$ | — | — | 3–4 | 4–5 | 20 | ○ - Δ |
| 18 | T | $7.8\times10^{7}$ | $5.2\times10^{9}$ | $3.4\times10^{9}$ | $9.3\times10^{9}$ | — | 3 | 4 | Above 3 mins. | ○ |
| 19 | P | $4.5\times10^{8}$ | $8.7\times10^{9}$ | $4.1\times10^{9}$ | $1.0\times10^{10}$ | — | 4 | 5 | 31 | Δ |
| 20 | P | $9.3\times10^{7}$ | $5.0\times10^{9}$ | $3.3\times10^{9}$ | $9.6\times10^{9}$ | — | 3 | 4–5 | 93 | Δ - ○ |
| 21 | P | $2.1\times10^{8}$ | $6.8\times10^{9}$ | $2.3\times10^{9}$ | $1.1\times10^{10}$ | — | 3–4 | 4 | 45 | Δ |
| Ref. Example 1 | M | $3.8\times10^{8}$ | $4.3\times10^{9}$ | $3.7\times10^{9}$ | $1.3\times10^{10}$ | — | 3 | 2 | 63 | Δ |
| Ref. Example 2 | M | $4.1\times10^{8}$ | $5.5\times10^{9}$ | $4.4\times10^{9}$ | $9.1\times10^{9}$ | — | 3 | 4 | Above 3 mins. | Δ |
| Aqueous system | Water | $5.5\times10^{8}$ | $5.6\times10^{10}$ | $1.5\times10^{12}$ | — | — | 4 | 3–4 | 25 | X |
| Blank | — | Above $10^{12}$ | Above $10^{12}$ | Above $10^{12}$ | Above $10^{12}$ | — | 4–5 | 4 | Above 3 mins. | Δ - ○ |

Table 2

| Example No. | Solvent for treatment | Antistatic property (insulating resistance Ω/cm) Before laundry | After laundry (5 times) Wet / Dry | After laundry (10 times) Wet / Dry | Feeling (Softness) |
|---|---|---|---|---|---|
| Polyacrylic (knitted fabric) | | | | | |
| 2 | T | $1.2\times10^{8}$ | $2.6\times10^{10}$ / $4.2\times10^{9}$ | $3.4\times10^{10}$ / $4.8\times10^{9}$ | Δ |
| 3 | P | $6.2\times10^{7}$ | $1.5\times10^{10}$ / $3.3\times10^{9}$ | $2.1\times10^{10}$ / $4.1\times10^{9}$ | ○ - Δ |
| 4 | P | $5.3\times10^{7}$ | $2.6\times10^{10}$ / $2.5\times10^{9}$ | $8.5\times10^{10}$ / $5.5\times10^{9}$ | Δ |
| 5 | P | $7.6\times10^{7}$ | $3.4\times10^{10}$ / $1.8\times10^{9}$ | $4.1\times10^{10}$ / $6.6\times10^{9}$ | Δ |
| 7 | P | $8.4\times10^{7}$ | $9.4\times10^{9}$ / $3.1\times10^{9}$ | $1.7\times10^{10}$ / $5.5\times10^{9}$ | Δ |
| 8 | T | $9.1\times10^{7}$ | $1.1\times10^{10}$ / $4.2\times10^{9}$ | $3.4\times10^{10}$ / $8.8\times10^{9}$ | Δ - X |
| 9 | T | $2.1\times10^{9}$ | $6\times10^{10}$ / $5.1\times10^{9}$ | $9.1\times10^{10}$ / $7.7\times10^{9}$ | Δ - X |
| 12 | P | $5.5\times10^{7}$ | $4\times10^{10}$ / $1.2\times10^{9}$ | $8.8\times10^{10}$ / $3.5\times10^{9}$ | ○ - Δ |
| 13 | T | $8.1\times10^{7}$ | $2.1\times10^{10}$ / $9.6\times10^{8}$ | $6.7\times10^{10}$ / $3.6\times10^{9}$ | ○ |
| 14 | P | $1.5\times10^{8}$ | $1.8\times10^{10}$ / $1.5\times10^{9}$ | $4.1\times10^{10}$ / $3.7\times10^{9}$ | Δ - ○ |
| 15 | P | $9.3\times10^{7}$ | $9.7\times10^{9}$ / $2.2\times10^{9}$ | $3.2\times10^{10}$ / $5.8\times10^{9}$ | ○ |
| 16 | T | $5.4\times10^{7}$ | $1.0\times10^{10}$ / $2.0\times10^{9}$ | $5.2\times10^{10}$ / $8.6\times10^{9}$ | Δ |
| 17 | P | $8.3\times10^{7}$ | $5\times10^{10}$ / $7.6\times10^{9}$ | $4.8\times10^{10}$ / $1.2\times10^{10}$ | ○ |
| Aqueous system | Water | $1.5\times10^{9}$ | $4.0\times10^{11}$ / $8.5\times10^{9}$ | $8.5\times10^{11}$ / $9.2\times10^{9}$ | X |
| Blank | — | $10^{12}$ | $10^{12}$ | $10^{12}$ | ○ - Δ |

Table 3

| Example No. | Solvent for treatment | Antistatic property (insulating resistance Ω/cm) Before laundry | After laundry (5 times) Wet / Dry | After laundry (10 times) Wet / Dry | Feeling (Softness) |
|---|---|---|---|---|---|
| Nylon (tricot) | | | | | |
| 2 | T | $3.2\times10^{8}$ | $7.4\times10^{9}$ / $9.3\times10^{9}$ | $9.5\times10^{9}$ / $4.2\times10^{10}$ | Δ |
| 3 | P | $1.1\times10^{8}$ | $8.5\times10^{9}$ / $7.3\times10^{9}$ | $5.5\times10^{9}$ / $7.4\times10^{9}$ | ○ |
| 4 | P | $9.6\times10^{7}$ | $1.2\times10^{10}$ / $3.5\times10^{9}$ | $1.3\times10^{10}$ / $5.2\times10^{9}$ | Δ |
| 5 | P | $1.5\times10^{8}$ | $8.2\times10^{9}$ / $1.1\times10^{10}$ | $8.1\times10^{9}$ / $2.1\times10^{10}$ | Δ − ○ |
| 7 | P | $1.3\times10^{8}$ | $6.5\times10^{9}$ / $1.6\times10^{10}$ | $8.0\times10^{9}$ / $2.7\times10^{10}$ | Δ |
| | | | $4.1\times10^{9}$ | $6.7\times10^{9}$ | |

Table 3-continued

| Example No. | Solvent for treatment | Nylon (tricot) Antistatic property (insulating resistance Ω/cm) Before laundry | After laundry (5 times) (Wet / Dry) | After laundry (10 times) (Wet / Dry) | Feeling (Softness) |
|---|---|---|---|---|---|
| 8 | T | $1.0\times10^{8}$ | $8.8\times10^{9}$ | $8.6\times10^{9}$ | Δ |
| | | | $8.5\times10^{9}$ | $1.1\times10^{10}$ | |
| 9 | T | $2.2\times10^{8}$ | $7.0\times10^{9}$ | $6.2\times10^{9}$ | Δ |
| | | | $4.4\times10^{9}$ | $8.1\times10^{9}$ | |
| 12 | P | $8.1\times10^{7}$ | $7.3\times10^{9}$ | $6.9\times10^{9}$ | ○ |
| | | | $2.8\times10^{10}$ | $5.1\times10^{10}$ | |
| 13 | T | $1.1\times10^{8}$ | $6.1\times10^{9}$ | $1.2\times10^{10}$ | ○ |
| | | | $3.6\times10^{9}$ | $4.4\times10^{9}$ | |
| 14 | P | $3.1\times10^{8}$ | $6.2\times10^{9}$ | $1.2\times10^{10}$ | Δ – ○ |
| | | | $2.5\times10^{9}$ | $6.5\times10^{9}$ | |
| 15 | P | $1.1\times10^{8}$ | $5.8\times10^{9}$ | $9.6\times10^{9}$ | ○ |
| | | | $6.2\times10^{9}$ | $7.1\times10^{9}$ | |
| 16 | T | $9.3\times10^{7}$ | $5.5\times10^{9}$ | $8.8\times10^{9}$ | Δ |
| | | | $7.3\times10^{9}$ | $8.5\times10^{9}$ | |
| 17 | P | $1.3\times10^{8}$ | $6.2\times10^{9}$ | $1.1\times10^{10}$ | Δ – ○ |
| | | | $2.5\times10^{10}$ | $8.4\times10^{10}$ | |
| Aqueous system | Water | $2.8\times10^{8}$ | $1.2\times10^{10}$ | $3.5\times10^{10}$ | X |
| Blank | — | $10^{12}$ | $10^{12}$ | $10^{12}$ | ○ – Δ |

In the following Examples 22 to 26, various properties of the treated fabrics were measured by the following methods:

Laundry:

Machine; Laundry machine of Toshiba VH-800 (Revolutions of 435 rpm)

Detergent; Heavy Duty detergent ("New Wonderful" of Kao Soap Co., Ltd.) Concentration 2 g/l Bath ratio; 1 : 50

Laundry condition; 40°C × 15 minutes and water washing for 5 minutes

The above treatment constitutes one laundry and the same operation is repeated.

Electrification voltage:

Test pieces of 5 × 7 cm cut from the treated cloth were allowed to stand at 20°C under 50% RH for 24 hours and electrification voltages of the test pieces were measured by a rotary static tester (of Kyodai Kaken type and manufactured by Koa Shokai), using cotton calico No. 3 as rubbing cloth and under a load of 500 g and at revolutions of 760 rpm. Average of the 4 values was taken as the electrification voltage.

Insulating resistance:

Five test pieces in round shape (diameter 5 cm) were cut from the sample cloth and allowed to stand at 20°C under 50% RH. Insulating resistances of the test pieces were measured with an electrometer (manufactured by Takeda Riken Co., Ltd.). Average of the 5 values was taken.

Feeling (Hand):

Appearance and hand feeling of the sample cloth were judged by a panel of 10 persons according to the following standards of judgement and average was taken.

| | |
|---|---|
| Very Excellent | 5 |
| Excellent | 4 |
| Ordinary | 3 |
| A little inferior | 2 |
| Inferior | 1 |

Workability (Gum up):

An endless cloth of polyester tropical (75 d/32 f/2) of 40 cm width was padded in the treating solution, nipped under 2 kg/cm² and further dried at 80°C. This operation was repeated at a speed of 7 m/min for a period of 30 minutes and the workability was judged by the following standards of judgement:

| | |
|---|---|
| No gum up | ○ |
| Gum up on the mangle | Δ |
| Gum up on the cloth | X |

EXAMPLE 22

A polyester tropical (75 d/32 f/2, density of 80 yarns/inch was dipped in an organic solvent solution having a composition shown in Table 4 at a room temperature and nipped at a squeezing ratio of 100% o.w.f. Then, it was dried at 80°C for one minute and heated at 160°C for 2 minutes for setting. In Table 4, a complex compound of poly(2-methacryloyloxyethyldimethylethylammonium ethosulfate) and sodium trioxyethylenedodecyl ether sulfate prepared in Example 3 was used. Compositions of treating solutions and test results are summarized in Table 4.

Table 4

| No. | Complex compound | Isopropyl alcohol | Perchloroethylene | Amount of attached compound (% owf) | Antistatic property (Upper column: Electrification voltage (V); Lower column: Resistance (Ω)) Before laundry | After 1 laundry | After 5 laundry | Feeling | Workability (gum up) |
|---|---|---|---|---|---|---|---|---|---|
| 1 | 0 | 0 | 0 | 0 | 5,400<br>$> 2\times10^{12}$ | — | — | 4.8 | — |
| 2 | 0 | 0 | 100 | 0 | 5,800<br>$> 2\times10^{12}$ | — | — | 4.9 | ○ |
| 3 | 0.05 | 0.05 | 99.9 | 0.05 | 640<br>$8.6\times10^{8}$ | 4,250<br>$4.3\times10^{10}$ | 4,150<br>$5.8\times10^{10}$ | 4.7 | ○ |
| 4 | 0.1 | 0.1 | 99.8 | 0.1 | 150<br>$1.2\times10^{8}$ | 2,200<br>$3.1\times10^{10}$ | 2,400<br>$2.3\times10^{10}$ | 4.5 | ○ |
| 5 | 0.25 | 0.25 | 99.5 | 0.25 | 65<br>$7.8\times10^{7}$ | 1,780<br>$9.7\times10^{9}$ | 2,100<br>$1.8\times10^{10}$ | 4.3 | ○ |
| 6 | 0.5 | 0.5 | 99.0 | 0.5 | 15<br>$6.6\times10^{7}$ | 1,300<br>$9.8\times10^{9}$ | 1,800<br>$1.2\times10^{10}$ | 4.3 | ○ |
| 7 | 1 | 1 | 98.0 | 1 | 5<br>$4.2\times10^{7}$ | 760<br>$6.4\times10^{9}$ | 610<br>$7.3\times10^{9}$ | 3.8 | ○ |
| 8 | 2.5 | 2.5 | 95.0 | 2.5 | 10<br>$2.5\times10^{7}$ | 560<br>$5.1\times10^{9}$ | 670<br>$7.8\times10^{9}$ | 3.4 | ○ |
| 9 | 5 | 5 | 90.0 | 5 | 13<br>$1.2\times10^{7}$ | 370<br>$4.3\times10^{9}$ | 720<br>$6.1\times10^{9}$ | 3.0 | ○ - Δ |
| 10 | 10 | 10 | 80.0 | 10 | 7<br>$2.1\times10^{7}$ | 230<br>$1.2\times10^{9}$ | 450<br>$2.1\times10^{9}$ | 2.6 | Δ |
| 11 | 15 | 15 | 70.0 | 15 | 11<br>$9.3\times10^{6}$ | 130<br>$5.3\times10^{8}$ | 240<br>$9.3\times10^{8}$ | 1.9 | X |
| 12 | 15 | 20 | 65.0 | 15 | 8<br>$8.2\times10^{6}$ | 70<br>$3.8\times10^{8}$ | 170<br>$8.3\times10^{8}$ | 2.1 | X |

EXAMPLE 23

A polyester jersey (310 g/yard) was dipped in an organic solvent solution, obtained by dissolving 0.3% by weight of a complex compound in 0.3% by weight of isopropyl alcohol and then diluting it with 99.4% by weight of an organic solvent shown in Table 5, at a room temperature, nipped by a mangle to a squeezing ratio of 160% and dried at 80°C for 1 minute. As the complex compound, a complex compound from copolymer of 2-methacryloyloxyethyldimethylethylammonium ethosulfate and acrylamide (1 : 1) and sodium dioctylsuccinate monosulfonate was used. Test results are shown in Table 5.

Further, the electrification voltage of the unfinished test piece was 6200 V and its insulating resistance was more than $2 \times 10^{12}$ Ω. In case water was used as diluent instead of an organic solvent, the complex compound was insoluble in water and, therefore, the test was impossible to be carried out. The solubility in Table 5 was determined by observing the state of the solution by naked eyes after a sufficient agitation and 5 hours' standing.

The standards for judgement are as follows:

| | |
|---|---|
| Dissolved | ○ |
| Dissolved (swollen) | Δ |
| Insoluble | X |

Table 5

| No. | Organic solvent | Antistatic property (Upper column: Electrification voltage (V); Lower column: Resistance (Ω)) Before laundry | After 1 laundry | After 5 laundry | Solubility | Feeling |
|---|---|---|---|---|---|---|
| 1 | Trichloroethylene | 60<br>$8.4\times10^{7}$ | 1,800<br>$7.2\times10^{9}$ | 2,100<br>$1.2\times10^{10}$ | ○ | 3.8 |
| 2 | Methylchloroform | 75<br>$7.8\times10^{7}$ | 1,450<br>$5.2\times10^{9}$ | 1,700<br>$8.3\times10^{10}$ | ○ | 4.1 |
| 3 | Acetone | 120<br>$1.2\times10^{8}$ | 2,150<br>$1.4\times10^{10}$ | 2,350<br>$2.5\times10^{10}$ | ○ | 4.2 |
| 4 | Cyclohexane | 85<br>$9.8\times10^{7}$ | 2,300<br>$1.0\times10^{10}$ | 2,650<br>$4.3\times10^{10}$ | ○ | 3.7 |
| 5 | Diethylether | 145<br>$2.5\times10^{8}$ | 1,800<br>$9.8\times10^{9}$ | 2,800<br>$1.8\times10^{10}$ | ○ | 3.9 |
| 6 | Ethylacetate | 180<br>$1.2\times10^{8}$ | 2,200<br>$1.2\times10^{10}$ | 2,450<br>$3.2\times10^{10}$ | ○ | 3.2 |

EXAMPLE 24

Acryl tricot (140 g/m²), nylon tricot (135 g/m²), T/C (65/35) broad and cotton broad were used as test cloth and each test cloth was dipped in an organic solvent solution, obtained by dissolving 0.3% by weight of a complex compound in 0.3% by weight of ethyl alcohol and then diluting it with 99.4% by weight of perchloroethylene, at a room temperature, nipped to a squeezing ratio of 150% o.w.f. and dried at 80°C for one minute. As the complex compound, a complex compound from copolymer of 2-methacryloyloxyethyldimethylethylammonium ethosulfate and acrylonitrile (3 : 1) and sodium pentaoxyethylene nonyl phenyl ether sulfate was used.

Table 7

| No. | Complex compound | Ethyl alcohol | Perchloro ethylene | Antistatic property: Upper column: Electrification voltage (V) Lower column: Resistance (Ω) Before laundry | After 1 laundry | After 5 laundry | Solubility | Color fading (absorbance) |
|---|---|---|---|---|---|---|---|---|
| 1 | 0 | 0 | 100 | 6,100<br>$>2\times10^{12}$ | — | — | ○ | <0.05 |
| 2 | 0.3 | 0 | 99.7 | — | — | — | X | <0.05 |
| 3 | 0.3 | 0.06 | 99.64 | 60<br>$7.2\times10^{7}$ | 1,650<br>$4.8\times10^{7}$ | 2,100<br>$1.2\times10^{10}$ | Δ | <0.05 |
| 4 | 0.3 | 0.15 | 99.55 | 30<br>$5.3\times10^{7}$ | 1,750<br>$6.5\times10^{9}$ | 1,850<br>$9.7\times10^{9}$ | ○ | <0.05 |
| 5 | 0.3 | 0.3 | 99.4 | 15<br>$6.8\times10^{7}$ | 1,450<br>$8.7\times10^{9}$ | 1,750<br>$9.5\times10^{9}$ | ○ | 0.05 |
| 6 | 0.3 | 3 | 96.7 | 65<br>$5.9\times10^{7}$ | 1,700<br>$7.5\times10^{9}$ | 2,050<br>$9.3\times10^{9}$ | ○ | 0.10 |
| 7 | 0.3 | 6 | 93.7 | 35<br>$8.3\times10^{7}$ | 1,600<br>$8.1\times10^{9}$ | 1,800<br>$7.5\times10^{9}$ | ○ | 0.15 |
| 8 | 0.3 | 15 | 84.7 | 20<br>$6.1\times10^{7}$ | 1,800<br>$7.1\times10^{9}$ | 1,950<br>$8.7\times10^{9}$ | ○ | 0.30 |

Test results are shown in Table 6.

Table 6

| No. | Test cloth | Antistatic property: non-finished | Upper column: Electrification voltage (V) Lower column: Resistance (Ω) Before laundry | After 1 laundry | After 5 laundry | Feeling |
|---|---|---|---|---|---|---|
| 1 | Acryl tricot | 6,100<br>$> 2\times10^{12}$ | 110<br>$8.2\times10^{7}$ | 2,000<br>$9.1\times10^{9}$ | 2,425<br>$1.2\times10^{10}$ | 4.2 |
| 2 | Nylon tricot | 4,800<br>$> 2\times10^{12}$ | 230<br>$1.1\times10^{8}$ | 1,950<br>$8.7\times10^{9}$ | 2,150<br>$2.2\times10^{10}$ | 3.7 |
| 3 | T/C broad | 3,200<br>$8.4\times10^{11}$ | 45<br>$7.5\times10^{7}$ | 1,280<br>$9.2\times10^{9}$ | 1,450<br>$1.2\times10^{10}$ | 4.3 |
| 4 | Cotton broad | 40<br>$1.3\times10^{8}$ | 185<br>$3.5\times10^{8}$ | 780<br>$4.4\times10^{9}$ | 650<br>$5.3\times10^{9}$ | 3.2 |

EXAMPLE 25

A dyed cloth of polyester cashmere (warp 150 d/32 f/1, weft 100 d/48 f/1) was dipped in an organic solvent solution shown in Table 7 at a room temperature, nipped to a squeezing ratio of 160% o.w.f. and dried at 120°C. Test results were shown in Table 7.

The dyeing was made be using Dianix violet 5RSE (manufactured by Mitsubishi Kasei Co., Ltd.) as dyestuff and employing a with temperature and pressure dyeing tester (Colorpet 12 manufactured by Japan Dyeing Machinery Co., Ltd.), at a concentration of 4% o.w.f. and 130°C for 60 minutes by a bath ratio of 1 : 30. The reducing washing treatment was conducted by employing the same apparatus as used in the dyeing, in which 2 g/l of hydrosulfite, 2 g/l of soda ash and 2 g/l of Amilazine D (manufactured by Daiichi Kogyo Seiyaku Co., Ltd.) were used, and the treatment was carried out at 100°C for 30 minutes by a bath ratio of 1 : 50.

The color fading in Table 7 was determined by measuring the absorbance of each organic solvent solution after the treatment at the maximum absorption wavelength, by employing Hitachi automatically recording spectrophotometer EPR-2 (manufactured by Hitachi Seisakusho) and using a cell of 1 cm size.

The solubility was determined by the same method as in Example 23.

Further, as the complex compound, a complex compound from poly(2-methacryloyloxyethyldimethylethylammonium sulfate) and N-methyl-N-(sodiumcarboxymethyl)-lauroamide was used.

EXAMPLE 26

A polyester twill (75 d/32 f/1) was dipped in an organic solvent solution, obtained by dissolving 0.5% by weight of a complex compound in 0.5% by weight of an alcohol shown in Table 8 and diluting it with 99% by weight of perchloroethylene, at a room temperature, nipped to a squeezing ratio of 140% o.w.f. and dried at 100°C for 1 minute. Test results are shown in Table 8.

The electrification voltage of the unfinished test cloth was 6800 V and its insulating resistance was more than $2 \times 10^{12}$ Ω.

As the complex compound, a complex compound from poly(2-methacryloyloxyethylenedimethylethylammonium sulfate) and sodium trioxyethylene dodecyl ether monophosphate was used.

Table 8

| No. | Alcohol | Antistatic property: Upper column: Electrification voltage (V) Lower column: Resistance (Ω) Before laundry | After 1 laundry | After 5 laundry | Feeling |
|---|---|---|---|---|---|
| 1 | Methyl alcohol | 45<br>$4.8\times10^{7}$ | 1,210<br>$8.5\times10^{9}$ | 1,530<br>$1.2\times10^{10}$ | 4.2 |
| 2 | Ethyl alcohol | 10<br>$5.8\times10^{7}$ | 920<br>$8.2\times10^{9}$ | 1,030<br>$9.3\times10^{9}$ | 4.0 |
| 3 | Isopropyl alcohol | 15<br>$4.3\times10^{7}$ | 870<br>$8.4\times10^{9}$ | 1,100<br>$9.8\times10^{9}$ | 4.1 |
| 4 | Propyl alcohol | 25<br>$5.1\times10^{7}$ | 1,020<br>$8.8\times10^{9}$ | 1,300<br>$1.1\times10^{10}$ | 4.3 |
| 5 | Butyl alcohol | 40<br>$6.9\times10^{7}$ | 1,250<br>$9.3\times10^{9}$ | 1,430<br>$1.3\times10^{10}$ | 3.9 |

What we claim is:

1. Hydrophobic fibers and fibrous structures having durable antistatic property, which contain deposited thereon from 0.1 to 10% by weight of a complex compound of a polyvinyl derivative having quaternary ammonium groups in its side chains, the counter anion thereof being substituted with at least one member selected from the group consisting of anionic surfactants containing 2 to 8 ethylene oxide units, ester-bonded sulfonates, alkylamidocarboxylic acid salts and amphoteric surfactants of carboxylic acid type.

2. The hydrophobic fibers and fibrous structures as claimed in claim 1, in which the amount of the complex compound deposited thereon is 0.2 to 3% by weight.

3. The hydrophobic fibers and fibrous structures as claimed in claim 1, in which the amount of the complex compound deposited thereon is 0.3 to 1.0% by weight.

4. The hydrophobic fibers and fibrous structures as claimed in claim 1, in which the hydrophobic fibers and fibrous structure are made of a synthetic polymer selected from the group consisting of polyesters, polyacrylonitriles, polyamides, polyvinyl chlorides, polyethylenes and polypropylenes.

5. The hydrophobic fibrous structure as claimed in claim 1, in which the hydrophobic fibrous structure is selected from staple fibers, continuous filaments, woven fabrics, knitted fabrics, non-woven fabrics and battings which contains more than 50% by weight of fibers made of a synthetic polymer selected from the group consisting of polyesters, polyacrylonitriles, polyamides, polyvinyl chlorides, polyethylenes and polypropylenes.

6. Hydrophobic fibers and fibrous structures as claimed in claim 1, in which said complex compound is A. poly(2-methacryloyloxyethyltrialkylammonium) cationic polymer, containing from zero to one moles, per mole of 2-methacryloyloxyethyltrialkylammonium units, of units of a second monomer having the formula

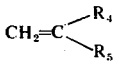

wherein $R_4$ is H or methyl, and $R_5$ is alkoxycarbonyl, alkoxy, $-CONH_2$, $-COOH$, $-CN$ or $-C_6H_5$, the anion of said polymer having been replaced by, B. counter anion of at least one surfactant selected from the group consisting of anionic surfactants containing 2 to 8 ethylene oxide units, ester-bonded sulfonates, alkylamidocarboxylic acid salts and amphoteric surfactants of the carboxylic acid type.

7. A process for producing a hydrophobic fibrous structure having a durable antistatic property, which comprises applying to a fibrous structure an organic solvent solution consisting of 0.05 to 10% by weight of a complex compound of a polyvinyl derivative having quaternary ammonium groups in its side chains, the counter anion thereof being substituted with at least one member selected from the group consisting of anionic surfactants containing 2 to 8 ethylene oxide units, ester-bonded sulfonates, alkylamidocarboxylic acid salts and amphoteric surfactants of carboxylic acid type, 0.05 to 20% by weight of an alcohol and more than 70% by weight of at least one organic solvent selected from the group consisting of hydrocarbons, halogenated hydrocarbons, ethers, ketones and esters, the weight ratio of said alcohol to said complex compound being more than 0.2/1, whereby to deposit on the fibrous structure from 0.1 to 10% by weight of said complex compound.

8. The process as claimed in claim 7, in which the concentration of said complex compound in the organic solvent solution is 0.2 to 3.0% by weight.

9. The process as claimed in claim 7, in which the concentration of said complex compound in the organic solvent solution is 0.3 to 1.0% by weight.

10. The process as claimed in claim 7, in which the alcohol is selected from ethyl alcohol and isopropyl alcohol.

11. The process as claimed in claim 7, in which the concentration of the alcohol in the organic solvent solution is 0.2 to 6% by weight.

12. The process as claimed in claim 7, in which the concentration of the alcohol in the organic solvent solution is 0.3 to 2% by weight.

13. The process as claimed in claim 7, in which the weight ratio of the alcohol to the complex compound is 0.5 to 3.0 parts of the alcohol to 1 part of the complex compound.

14. The process as claimed in claim 7 in which the weight ratio of the alcohol to the complex compound is 1 to 20 parts of the alcohol to 1 part of the complex compound.

15. The process as claimed in claim 7, in which the organic solvent is a halogenated hydrocarbon.

16. The process as claimed in claim 15, in which the halogenated hydrocarbon is selected from the group of methylchloroform, trichloroethylene and perchloroethylene.

17. The process as claimed in claim 7, in which the concentration of the organic solvent in the organic solvent solution is 92 to 99.6% by weight.

18. The process as claimed in claim 7, in which the concentration of the organic solvent solution is 97 to 99.4% by weight.

19. A process as claimed in claim 7, in which said complex compound is

A. poly(2-methacryloyloxyethyltrialkylammonium) cationic polymer, containing from zero to one moles, per mole of 2-methacryloyloxyethyltrialkylammonium units, of units of a second monomer having the formula

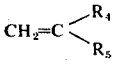

wherein $R_4$ is H or methyl, and $R_5$ is alkoxycarbonyl, alkoxy, $-CONH_2$, $-COOH$, $-CN$ or $-C_6H_5$, the anion of said polymer having been replaced by, B. counter anion of at least one surfactant selected from the group consisting of anionic surfactants containing 2 to 8 ethylene oxide units, ester-bonded sulfonates, alkylamidocarboxylic acid salts and amphoteric surfactants of the carboxylic acid type.

* * * * *

UNITED STATES PATENT AND TRADEMARK OFFICE

CERTIFICATE OF CORRECTION

PATENT NO. : 3 952 128

DATED : April 20, 1976

INVENTOR(S) : Yuzuru Ogata et al

It is certified that error appears in the above-identified patent and that said Letters Patent are hereby corrected as shown below:

Please correct the title page to also include the Claim of Priority shown below.

August 30, 1972 Japan ..... 78977/72

Signed and Sealed this

Twentieth Day of July 1976

[SEAL]

*Attest:*

RUTH C. MASON
*Attesting Officer*

C. MARSHALL DANN
*Commissioner of Patents and Trademarks*